US009224256B2

(12) United States Patent
Rosenberger et al.

(10) Patent No.: US 9,224,256 B2
(45) Date of Patent: Dec. 29, 2015

(54) WALK-THROUGH SECURITY GATE, IN PARTICULAR FOR USE AT AIRPORTS

(75) Inventors: Lars Rosenberger, Baden-Baden (DE); Roland Ebert, Achern-Moesbach (DE)

(73) Assignee: Kaba Gallenschuetz GmbH, Buehl (DE)

( * ) Notice: Subject to any disclaimer, the term of this patent is extended or adjusted under 35 U.S.C. 154(b) by 135 days.

(21) Appl. No.: 14/342,840

(22) PCT Filed: Sep. 5, 2012

(86) PCT No.: PCT/DE2012/100269

§ 371 (c)(1),
(2), (4) Date: Mar. 5, 2014

(87) PCT Pub. No.: WO2013/034151

PCT Pub. Date: Mar. 14, 2013

(65) Prior Publication Data

US 2014/0197919 A1 Jul. 17, 2014

(30) Foreign Application Priority Data

Sep. 6, 2011 (DE) ..... 20 2011 051 222 U

(51) Int. Cl.
*G07C 9/00* (2006.01)
*G07C 9/02* (2006.01)

(52) U.S. Cl.
CPC ..... *G07C 9/00103* (2013.01); *G07C 9/00007* (2013.01); *G07C 9/00031* (2013.01); *G07C 9/00087* (2013.01); *G07C 9/02* (2013.01); *G07C 9/025* (2013.01)

(58) Field of Classification Search
CPC ..... G07C 9/025; G07C 9/02; G07C 9/00087; G07C 9/00007; G07C 9/00031
See application file for complete search history.

(56) References Cited

U.S. PATENT DOCUMENTS 4,939,355 A * 7/1990 Rando ..... A47F 9/046 235/462.14
8,164,775 B2 * 4/2012 Soderberg ..... B41J 3/44 283/23

(Continued)

FOREIGN PATENT DOCUMENTS

DE 10 2006 048 618 A1 4/2008
DE 10 2010 016 098 A1 9/2011

OTHER PUBLICATIONS

International Search Report of PCT/DE2012/100269, mailed Dec. 11, 2012.

*Primary Examiner* — Andrew Bee
(74) *Attorney, Agent, or Firm* — Collard & Roe, P.C.

(57) ABSTRACT

The invention relates to a walk-through security gate (1), in particular for the use at airports for demarcation between a secured zone and an unsecured zone, wherein the gate can be opened in accordance with the checking of access data such as a flight ticket and a blocking element (6) that blocks the gate is pivoted from a blocked position into a walk-through position in the context. Corresponding fully automatic solutions are part of the prior art in the context. For various reasons, however, there is a need for being able to also operate such "self-boarding gates" semi-automatically, i.e. in conjunction with support staff, wherein in the context the problem of the operating personnel obstructing the gate delimited by guide elements (4) arises. According to the invention, the problems is solved in that a console (5) is associated with at least one of the guide elements (4) that delimit the gate, by means of which console (5) the access data can be automatically retrieved. At the same time, the console (5) is additionally provided with a manual scanner (8). When the manual scanner is put into operation, the scanner (7) of the console (5) used for the automatic checking is taken out of operation and thus the checking of the access data is possible in manual operation, and at least one blocking element (6) that blocks the gate is pivoted into a walk-through position only in accordance with the checking of the access data by means of a manual scanner (8).

8 Claims, 1 Drawing Sheet

(56) References Cited

U.S. PATENT DOCUMENTS

2004/0245335 A1* 12/2004 Al Amri ..... G06K 19/04 235/384
2005/0178840 A1* 8/2005 Chang ..... G06K 17/00 235/462.14
2010/0123004 A1 5/2010 Felkel et al.
2013/0002399 A1 1/2013 Frueh

* cited by examiner

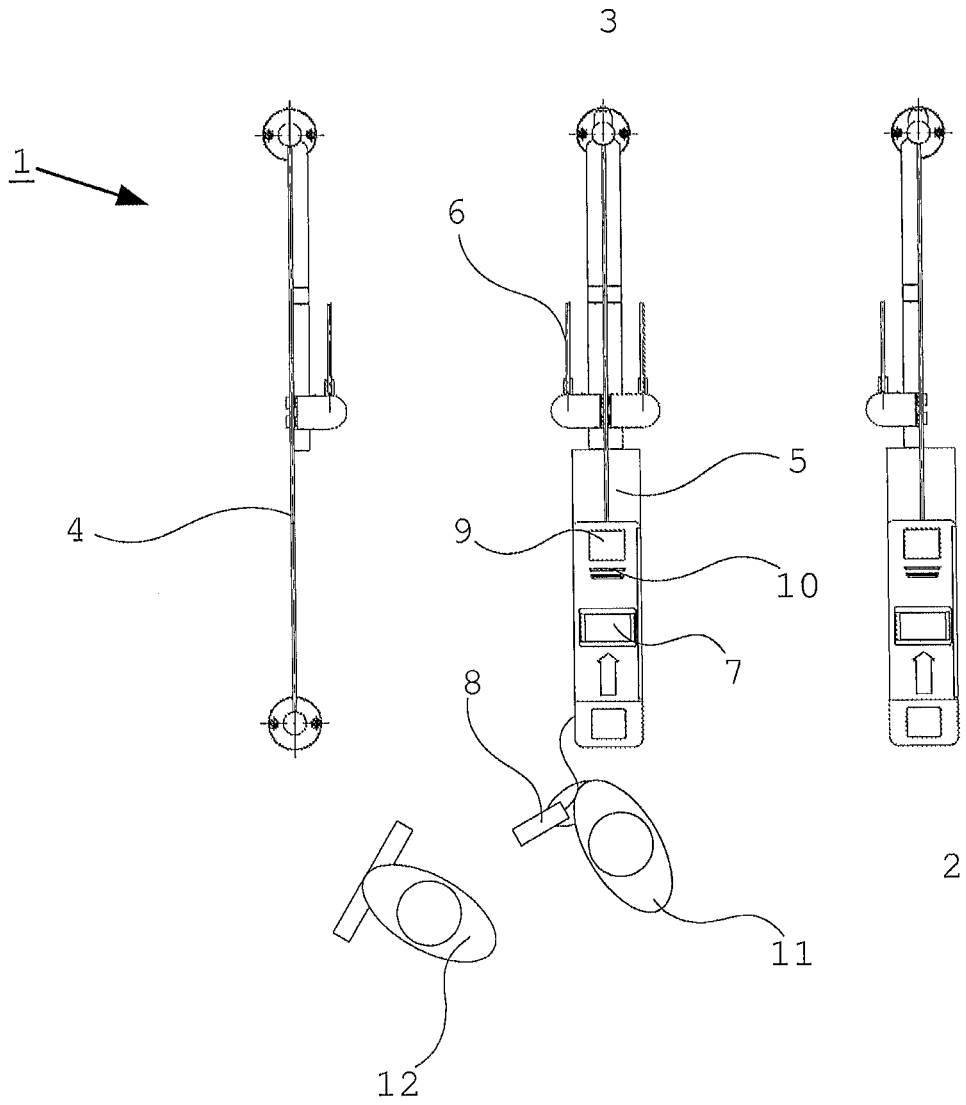
3
1
6
5
4
9
10
7
8
2
11
12

WALK-THROUGH SECURITY GATE, IN PARTICULAR FOR USE AT AIRPORTS

CROSS REFERENCE TO RELATED APPLICATIONS

This application is the National Stage of PCT/DE2012/100269 filed on Sep. 5, 2012, which claims priority under 35 U.S.C. §119 of German Application No. 20 2011 051 222.3 filed on Sep. 6, 2011, the disclosures of which are incorporated by reference. The international application under PCT article 21(2) was not published in English.

The present invention relates to a walk-through security gate, particularly for use at airports, having a passage delimited by guide elements, leading from a land side to an air side, to which passage at least one blocking element that can be pivoted between a blocked position and a walk-through position is assigned, whereby access data are queried by way of a console assigned to at least one of the guide elements, on the basis of which data a decision is made whether the blocking element is pivoted into its walk-through position or remains in the blocked position.

Such a walk-through security gate is already known from the German patent application DE 10 2006 048 618 A1. Furthermore, a method and an apparatus for automated monitoring of air passengers in airports are known from this document. In this connection, boarding pass checks are conducted within walk-through security gates. For this purpose, the walk-through security gates can be closed off by means of blocking elements, which operate as a function of the checking of the bar code of a boarding pass, which is read out using a scanner and compared with a central database, which stands in a data connection with the control point. The blocking element is then opened, or not, as a function of this checking. The boarding pass control points are furthermore equipped with display consoles that display the relevant information for the check-in procedure, in each instance.

Furthermore, an access control apparatus having the characteristics of paragraph 1 is previously known from DE 10 2010 016 098 AB 1. These walk-through security gates are frequently set up at airports, for example, to separate the secured area, called the air side, from the non-secured area, called the land side. The function according to the state of the art provides that the passenger enters the walk-through security gate with his flight ticket, and reads the flight ticket, together with his access data, into a scanner provided for this purpose. Checking of the access data takes place, and release of the walk-through passage occurs as a function of the result of the checking, by means of blocking elements situated in the walk-through passage being pivoted from a blocked position into a walk-through position.

However, it has been shown that depending on the airlines using the gate, these airlines might prefer personal care of their passengers and would like to shut off such self-service walk-through security gates. Since the scanner for reading the access data is usually installed in a console, which is assigned to the guide elements that channel the flow of persons, this leads to the result that the supervising personnel must be situated in the walk-through passage, in each instance, in order to accept the flight ticket, scan it, and return it to the passenger. Although the blocking elements remain permanently pivoted into their walk-through position during such operation, such a mode of operation is disadvantageous, because the personnel is also situated in the walk-through passage and stands in the passenger's way.

The present invention is therefore based on the task of creating a walk-through security gate that can fundamentally be operated as what is called a self-boarding gate, but if needed, can also be put out of operation and thereby converted to a walk-through passage with manual operation, supervised by personnel. In this connection, the disadvantages of the known method are supposed to be eliminated.

This is made possible by means of a walk-through security gate according to the characteristics of claim 1. Further practical embodiments of such a walk-through security gate can be derived from the dependent claims.

According to the invention, it is provided that a hand-held scanner is connected with the console that is assigned to a guide element, with which scanner the personnel can scan the access data of the flight tickets of the passengers at some distance from the console. In this connection, it is provided that when such a hand-held scanner, which is connected with the console, is started up, the blocking elements are immediately permanently pivoted into their walk-through position, so that the actual walk-through passage is kept open by the walk-through security gate. Vice versa, when the hand-held scanner is put out of operation, the original operation is restored, using the scanner integrated into the console. In this way, a variable system is created, in which both what is called self-boarding operation and supervised operation can be maintained.

Startup and shutdown of the hand-held scanner can take place, for example, in that such a hand-held scanner is plugged into a connector provided on the console for this purpose or removed from this connector. Another possibility of the configuration of the hand-held scanner consists in that it is connected with the console by way of a connection cable, but is hidden in a compartment in the area of the console, behind a door or the like, which is preferably secured and thereby withdrawn from access by unauthorized persons. In the latter case, self-boarding operation could be stopped when the door is opened or the hand-held scanner is taken out, for example, and supervised operation could be started.

Supplementally, it is practical to already clarify in the area of the walk-through security gate whether or not a passenger will sit in the area of an emergency exit. Those passengers who sit in the area of an emergency exit bear special responsibility and are required to support the flight personnel in suitable manner in the event of an emergency.

For this reason, an inquiry can take place, by way of a display that is ideally assigned to the console, as to whether, in the event that a passenger is sitting at an emergency exit, he is aware of this responsibility and is also able and willing to bear this responsibility.

In the event that this is not desired, and therefore a change in seat is to take place, new access data are drawn up, using a printer also assigned to the console, and issued to the passenger. The confirmation whether or not the seat is to be changed can take place by way of suitable input means, which are assigned to the display. For this purpose, the display can be structured as a touch screen, for example, so that a structural unit composed of display and input means can be provided in space-saving manner.

The invention described above will be explained in greater detail below, using an exemplary embodiment.

The drawing shows:

FIG. 1 a walk-through security gate according to the invention, in a schematic representation from above.

FIG. 1 shows a walk-through security gate 1 that is set up at an airport and separates a secured air side 3 from a non-secured land side 2 there. A passenger 12, who would like to walk through the walk-through security gate 1, is held up, during normal operation, by blocking elements 6 situated in a blocked position, so that he must first read his access data, which are stored on his flight ticket, in by way of a scanner 7.

In the present example, however, the walk-through security gate 1 is taken out of operation in that the personnel 11 has connected a hand-held scanner 8 to a console 5, in order to replace the scanner 7. In this connection, the scanner 7 has been taken out of operation, so that input by way of the scanner 7 is not possible during operation of the hand-held scanner 8. Because of this solution, it is possible to supervise the walk-through security gate 1 using personnel 11, without this personnel having to have direct access to the scanner 7 and thereby having to be situated in the walk-through area between the guide elements 4. Scanning of the required access data can therefore be undertaken in the area in front of the walk-through security gate 1, on the land side 2.

After the access data of a passenger 12 have been scanned, the passenger is confronted with a message on a touch screen 9, in the area of the console 5, in the event that this seat is a marked seat, particularly a seat at an emergency exit. In this case, the passenger 12 is asked, by means of a text on the touch screen 9, whether he is aware of the responsibility of such a seat and whether he is also willing and able to bear this responsibility. The passenger 12 now has the possibility of confirming this or asking for a different seat. In the event that the passenger 12 decides on a different seat, the system will determine such a different available seat and print out and eject new access data for the passenger 12 by way of a printer 10 also assigned to the console 5.

What is described above is therefore a walk-through security gate that makes it possible to switch back and forth between supervised operation and self-boarding operation, in simple manner, without a restriction of the walk-through width of the walk-through security gate being a complaint during supervised operation.

REFERENCE SYMBOL LIST

1 walk-through security gate
2 land side
3 air side
4 guide element
5 console
6 blocking element
7 scanner
8 hand-held scanner
9 touch screen
10 printer
11 personnel
12 passenger

The invention claimed is:

1. Walk-through security gate, particularly for use at airports, having a passage delimited by guide elements (4), leading from a land side (2) to an air side (3), to which passage at least one blocking element (6) that can be pivoted between a blocked position and a walk-through position is assigned, wherein access data are queried by way of a console (5) assigned to at least one of the guide elements (4), on the basis of which data a decision is made whether the blocking element (6) is pivoted into its walk-through position or remains in the blocked position, wherein at startup of a hand-held scanner (8), a scanner (7) assigned to the console (5) is put out of operation, and the hand-held scanner (8) is used for querying the access data, and the at least one blocking element (6) is permanently pivoted into its walk-through position.

2. Walk-through security gate according to claim 1, wherein the hand-held scanner (8) can be data-connected with the console (5) by way of a connector.

3. Walk-through security gate according to claim 1, wherein the hand-held scanner (8) is laid into a preferably secured compartment of the console (5), and is data-connected with the console (5) there, by way of a cable connection.

4. Walk-through security gate according to claim 1, wherein the at least one blocking element (6) is pivoted back into its blocked position when the hand-held scanner (8) is put out of operation, and the access data are only queried by way of the console (5), on the basis of which data a decision is made whether the blocking element (6) is pivoted into its walk-through position or remains in the blocked position.

5. Walk-through security gate according to claim 1, wherein after every query procedure of access data, a check takes place to determine whether the access data relate to a marked seat in the area situated on the air side (3).

6. Walk-through security gate according to claim 5, wherein in the event that the access data relate to a marked seat in the area situated on the air side (3), a query takes place on a display assigned to the console (5) whether the seat is to be maintained or changed, and user input by way of input means assigned to the display is requested.

7. Walk-through security gate according to claim 6, wherein the display is a touch screen (9), which simultaneously represents the input means.

8. Walk-through security gate according to claim 6, wherein a printer (10) is assigned to the console (5), which printer prints out and ejects new access data in the event of a desired change in seat.

* * * * *